US005831645A

United States Patent [19]

Shimoda

[11] Patent Number: 5,831,645

[45] **Date of Patent: *Nov. 3, 1998**

[54] INK JET RECORDING APPARATUS AND METHOD FOR RECOVERING AN INK JET RECORDING HEAD USED FOR SUCH APPARATUS

[75] Inventor: Junji Shimoda, Chigasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 377,110

[22] Filed: Jan. 23, 1995

[30] Foreign Application Priority Data

Jan. 25, 1994 [JP] Japan ..... 6-006592
Aug. 26, 1994 [JP] Japan ..... 6-202534

[51] Int. Cl.[6] ..... B41J 2/165

[52] U.S. Cl. ..... 347/30; 347/24; 347/29

[58] Field of Search ..... 347/29, 30, 24, 347/43, 49, 15, 9, 23

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,728,968 | 3/1988 | Hillmann et al. | 347/43 |
| 4,740,796 | 4/1988 | Endo et al. | 346/1.1 |
| 4,847,637 | 7/1989 | Watanabe et al. | 346/140 R |
| 4,908,638 | 3/1990 | Albosta et al. | 347/43 |
| 4,952,942 | 8/1990 | Kanome et al. | 347/43 |
| 5,214,447 | 5/1993 | Iwata | 347/29 |

FOREIGN PATENT DOCUMENTS

| | | |
|---|---|---|
| 0446885 | 9/1991 | European Pat. Off. . |
| 0551752 | 7/1993 | European Pat. Off. . |
| 0580421 | 1/1994 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

A suction recovery mechanism for an ink jet recording apparatus for recording by selectively supporting a different ink jet recording head on a carriage includes a single cap member capable of covering the entire ink discharge port area of each of the different ink jet recording heads selectively supported on the carriage, and a suction mechanism communicating section provided for the cap member in order to perform suction recoveries of each of the ink jet recording heads selectively supported on the carriage. This suction mechanism communicating section is conductively connected with a suction mechanism for sucking ink retained in the cap member. With this arrangement, it becomes possible to widen the range of kinds of images which can be recorded by the apparatus. Also, with the provision of an additional structure to arrange a suction port within a black ink discharge area in the cap member which is conductively connected to a suction pump, it is possible to perform suction recoveries for a color recording head while suppressing color mixture at the time of recoveries.

18 Claims, 8 Drawing Sheets

INK JET RECORDING APPARATUS AND METHOD FOR RECOVERING AN INK JET RECORDING HEAD USED FOR SUCH APPARATUS

BACKGROUND OF THE INVENTION

1. Field of the Invention

This invention relates to an ink jet recording apparatus and a method for recovering an ink jet recording head used for such apparatus. More particularly, the invention relates to an ink jet recording apparatus provided with a cap member to cover an ink jet recording head which discharges ink of different densities (concentration), and a method for recovering each of the ink jet recording heads used for the apparatus.

2. Related Background Art

Conventionally, a technique of the kind has been to perform the formation of recorded images by use of an ink jet head provided with orifices for discharging droplets; nozzles conductively connected to the orifices; energy generating elements provided for the nozzle unit for discharging droplets; a common liquid chamber for supplying ink to the plural nozzles; also, an ink tank which retains a specific amount of ink; and further, an electric signal terminal and others formed together for driving the energy generating elements, and then, to mount this ink jet head on a carriage installed on the apparatus main body (a printer), thus connecting the ink jet head and the apparatus main body by fixing the head on the carriage so that recording droplets can be discharged in accordance with image information.

However, in accordance with the conventional technique described above, one and the same kind of ink jet head is installed on the apparatus main body. As a result, a problem is encountered that the kinds of recordable images are limited.

Also, in a conventional ink jet recording apparatus wherein plural kinds of heads can be installed on one and the same apparatus main body exchangeably, a problem is encountered that the size of the apparatus becomes larger as a whole because caps of plural configurations are needed for plural kinds of ink jet heads having discharge port surfaces of different configurations.

Also, from the different point of view, if at least one of ink jet recording heads, which can be selectively mounted on a carriage, is structured to be able to discharge many different kinds of ink, it is impossible to perform stabilized suction recoveries as a whole due to the different properties of each ink or the different fluid resistances created in each ink discharge path. To counteract this, therefore, it is generally practiced that the suction recovery is performed by the provision of each individual cap for each area of ink discharge ports, respectively. In this case, however, not only it becomes impossible to perform any suction recovery by use of this individual cap, but also there is a possibility that even discharge ports cannot be covered by such cap in some cases if the different ink jet recording heads should include the one dedicated to using only a monochromic color. As a result, when different ink jet recording heads are arranged with different distributions of discharge ports, there is a need for the provision of a plurality of different caps and suction pumps for performing reasonably effective suction recoveries or the provision of means for switching suction passages if only one suction pump should be employed for the plural caps thus provided. Obviously, this arrangement invites making an apparatus larger as a whole and its structure more complicated.

Also, when different caps are provided for each of the ink discharge port areas as in the conventional technique, the amount of sucked ink tends to become smaller relatively. As a result, such ink is not sufficient enough when it is given to fill each of the small-diameter tubes or tube paths for use of the required recovery, hence ink being allowed to stick together to cause a phenomenon of ink deposition in the suction recovery paths in some cases. This is a problem to be solved anew.

SUMMARY OF THE INVENTION

The present invention is designed by inverting the technical thought after clearing off such technical views described above, and is aimed at providing a method for recovering ink jet heads stably by suppressing the ink deposition and adhesion to the suction recovery paths by the positive utilization of ink mixture in operating suction recoveries.

It is another object of the invention to provide an ink jet recording apparatus comprising a single carriage arranged to support and fix, for common use, plural kinds of ink jet heads having different numbers of nozzles, plural kinds of ink jet heads having different nozzle pitches, or plural kinds of ink jet heads which discharge a monochromic or multiple colors of ink, and an electrically coupling unit which is connected to the electric signal terminal surface provided for each of the ink jet heads; and a single cap to cover the recording droplet discharge port surface of each of the ink jet heads in common, thus making it possible to select the kinds of recordable images in a wide range by exchanging the aforesaid plural ink jet heads, and also, provide a method for recovering each of the ink jet recording heads used for such apparatus.

It is still another object of the invention to provide an ink jet recording apparatus whose size is made smaller as a whole than the conventional ink jet recording apparatus which is provided with caps of plural configurations correspondingly for the plural kinds of ink jet head having discharge port surfaces of different configurations: this is achieved by arranging the cap to be a single member for common use to cover the discharge port surfaces of each of the plural ink jet heads in accordance with the present invention, and also, to provide a method for recovering each of the ink jet recording heads used for such apparatus.

It is a further object of the invention to provide an ink jet recording apparatus having recovery means for performing suction recoveries through a single cap member capable of covering each of discharge port units of different ink jet recording heads selectively mounted on the ink jet recording apparatus for recording by selectively mounting each of the different ink jet recording heads on a carriage which can support the mounted ink jet head electrically and mechanically, and also, provide a method for recovering the ink jet recording heads used for such apparatus.

It is still a further object of the invention to provide an ink jet recording apparatus wherein the suction port of a cap member, which serves as the connecting unit for a suction pump, faces the central region of the discharge port area of a black ink jet recording head, and at the same time, faces the position deviated to the color ink discharge port area side other than black within the range corresponding to the black ink discharge port area of color ink jet recording heads, and also, provide a method for recovering each ink jet recording heads used for such apparatus.

It is another object of the invention to provide a recovery method for each of the selectively mountable ink jet recording heads of different kinds such as to be formed by an ink jet recording head which discharges only black ink, and by the color ink jet heads having discharge port areas for discharging yellow, magenta, cyan, and black ink in that order, and arranged to enable the deposition tendency of the yellow, magenta, cyan ink, and that of black ink to satisfy the different relationship, hence performing a suction recovery through a single cap member capable of covering the discharge port units of each of such different ink jet recording heads completely; and further, the aforesaid suction port of the cap member which serves as the connecting unit for the suction pump being arranged to face the central region of the discharge port area of the black ink jet recording head, and at the same time, facing a position deviated to the aforesaid cyan ink discharge port area side within the area facing the black ink discharge port area of the aforesaid color ink jet recording heads.

It is still another object of the invention to provide a suction recovery mechanism for an ink jet recording apparatus which records by selectively supporting a different ink jet recording head on a carriage, including the following:

a single cap member capable of covering the entire ink discharge port area of each of the different ink jet recording heads selectively supported on the carriage; and a suction mechanism communicating section provided for the cap member in order to perform suction recoveries of each ink jet recording head selectively supported on the carriage, this suction mechanism communicating section being conductively connected with a suction mechanism for sucking ink retained in the cap member.

It is still another object of the invention to provide an ink jet recording apparatus for recording by selectively supporting each of different ink jet heads on a carriage which supports each ink jet recording head, including the following:

a single cap member capable of covering the entire ink discharge ports of each of the different ink jet recording heads selectively supported on the carriage;

a suction mechanism for sucking ink retained in the cap member;

a suction mechanism communicating section provided for the cap member in order to perform suction recoveries of each ink jet recording head selectively supported on the carriage, this suction mechanism communicating section being conductively connected with the suction mechanism. It is still another object of the invention to provide an ink jet recording apparatus, including the following:

a carriage for supporting an ink jet recording head provided with discharge ports for discharging ink of different densities;

a cap member capable of covering ink discharge ports;

a suction mechanism for sucking ink retained in the cap member; and a suction mechanism communicating section which is conductively connected with the suction mechanism, and provided for the cap member in a position facing the discharge port area for the ink having the highest ink density to be discharged with respect to the ink of different densities.

It is still another object of the invention to provide a method for recovering an ink jet recording apparatus, including the following steps of:

arranging a carriage which selectively supports a monochrome ink jet recording head for discharging only black ink, and a color ink jet recording head provided with discharge areas each for yellow ink, magenta ink, cyan ink, and black ink to be discharged in that order for the carriage which supports each of the ink jet recording heads;

arranging a cap member capable of covering the entire ink discharge ports of the monochrome ink jet recording head or the color ink jet head selectively supported on the carriage;

arranging a suction mechanism for sucking ink retained in the cap member;

arranging a suction mechanism communicating section which is conductively connected with the suction mechanism, and provided for the cap member facing the central region of the discharge port area of the monochrome ink jet recording head, and at the same time, facing a position deviated to the cyan ink discharge port area side within the range facing the black ink discharge port area of the color ink jet recording heads.

It is still another object of the invention to provide a method for recovering an ink jet recording apparatus, including the following steps of:

arranging a carriage for supporting an ink jet recording head provided with discharge ports for discharging ink of different densities;

arranging a cap member capable of covering the entire ink discharge ports;

arranging a suction mechanism for sucking ink retained in the cap member;

arranging a suction mechanism communicating section which is conductively connected with the suction mechanism, and provided for the cap member in a position facing the discharge port area for the ink having the highest density to be discharged with respect to the ink of different densities.

DETAILED DESCRIPTION OF THE PREFERRED EMBODIMENTS

Hereinafter, in conjunction with the accompanying drawings, the description will be made of embodiments in accordance with the present invention.

Figure 1:
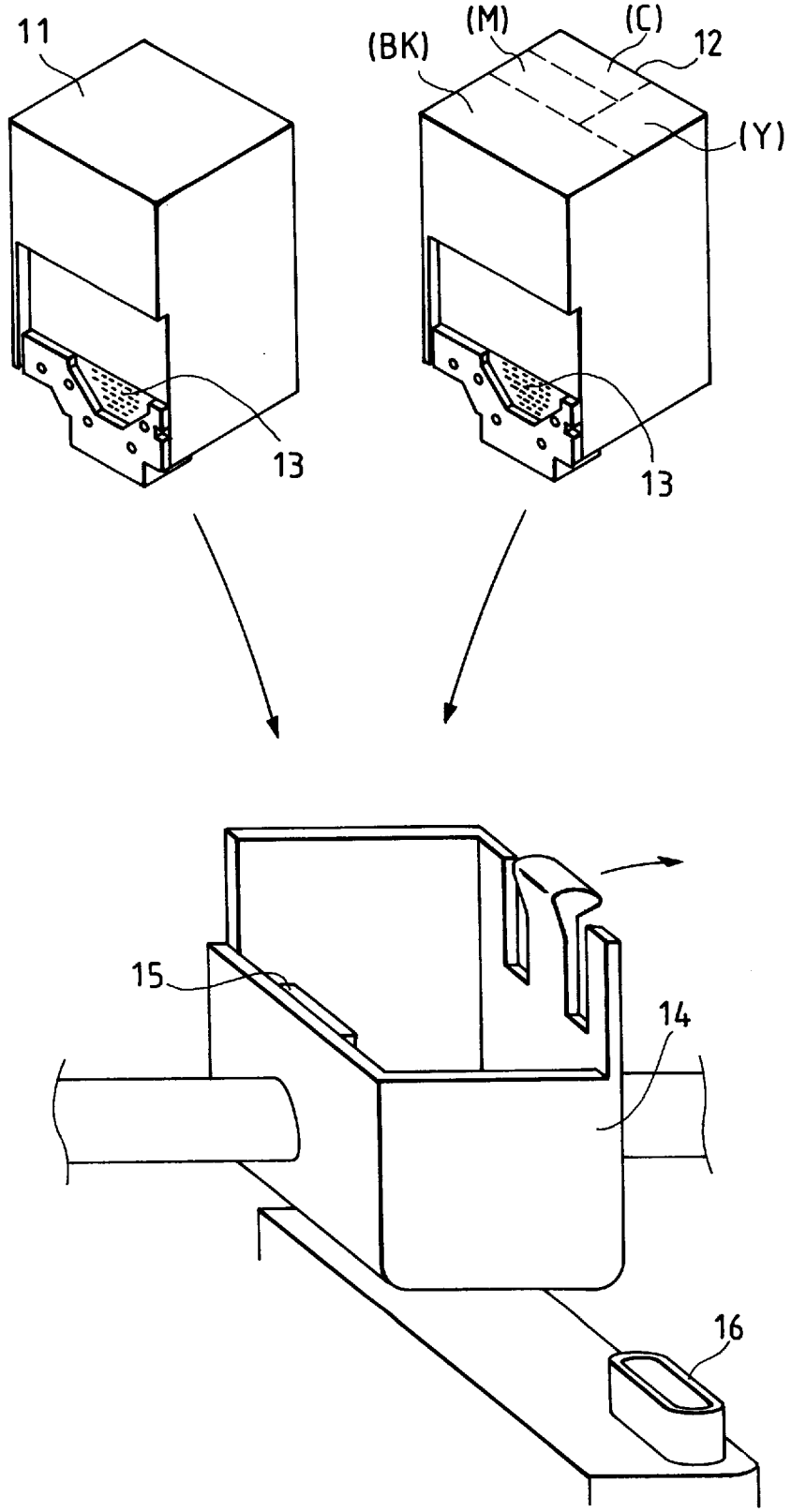
FIG. 1 is a view which schematically shows the entire body of an embodiment in accordance with the present invention.

FIG. 1 is a view which schematically shows the entire body embodying the present invention. In FIG. 1, a reference numeral 11 designates an ink jet head for use of monochrome having the orifices which discharge droplets for the formation of monochromic images; nozzles which are conductively connected with the orifices; a common liquid chamber for supplying ink to the plural nozzles; and an ink tank retaining a specific amount of ink, integrally formed in it; and 12, an ink jet head for use of colors having orifices, nozzles, a common liquid chamber, and an ink tank, integrally formed in it as the ink jet head 11 for use of monochrome, and further, ink tanks for cyan, yellow, magenta, and black color are separately mounted for use of each color. Here, in both heads, a reference numeral 13 designates an electric signal terminal for driving the energy generating elements formed in the nozzles of each head for discharging droplets; 14, a carriage which supports and fixes the ink jet head 11 for use of monochrome and the ink jet head 12 for use of colors in common; and 15, an electric signal terminal surface provided for the main body to connect with the electric signal terminal 13 for each head unit. The ink jet head 11 for use of monochrome and the ink jet head 12 for use of colors are exchangeable, and installed on the carriage 14, respectively, in accordance with its use.

A reference numeral 16 designates a cap to cover each of the recording droplet discharge surfaces (hereinafter referred to as a head surface) of the ink jet head 11 for use of monochrome and ink jet head 12 for use of colors for common use in order to prevent ink from the orifices in each head from being dried, and at the same time, to recover the defective condition such as a disabled discharge of droplet by sucking ink from the orifices in cooperation with a suction pump (not shown) to which the cap is connected. The cap 16 is a single member designed to connect with the two kinds of heads 11 and 12 for common use.

Figure 7:
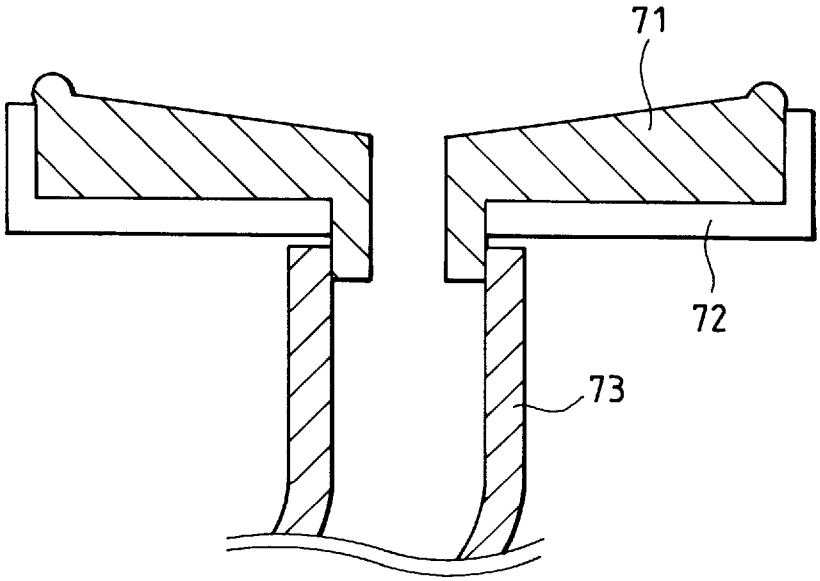
FIG. 7 is a sectional enlargement which shows a cap 16 schematically.

FIG. 7 is a detailed sectional view of the cap 16. In FIG. 7, a reference numeral 17 designates a cap rubber. In FIG. 7, the upper end of the cap engages with each discharge port surface of plural kinds of ink jet heads. In FIG. 7, with the suction port section which is positioned in the central portion of the cap rubber 71, there is no sucked ink residing in the cap rubber 71, hence making it possible to suck ink uniformly from nozzles in the central portion and both ends.

A reference numeral 72 designates a cap cover to support the cap rubber 71, and 73, the suction tube for a pump coupled with the cap rubber 71, which is conductively connected with a suction pump (not shown).

When the suction pump is driven to operate a suction after the cap 16 is coupled with the discharge port surface of the monochromic ink jet head 11 or color ink jet head 12, the suction is conducted for an optimal suction frequency and negative pressure in accordance with each kind of the heads. In other words, for the color ink jet head 12, the orifice area for discharging recording droplets is designed to be smaller because the amount of discharge is set at a lower level than the monochromic one in order to prevent bleeding from taking place on the surface of a recorded image when the colors are mixed by use of the color ink jet recording head 12. As a result, the resistance of ink flow in the head at the time of suction is higher for the color ink jet head 12, necessitating the suction frequency or negative pressure to be set at a higher level than the monochromic one. Hence it is necessary to set the different conditions of suction depending on each kind of heads.

Furthermore, in order to suppress bleeding of yellow, magenta, and cyan ink for the color ink jet head 12, surfactant is mixed in each of them. The head is designed to meet the ink composition having a higher viscosity than that of black ink. Therefore, when each kind of color ink is sucked at a time from the discharge port surface of the color ink jet head 12, it is possible to suck a greater amount of ink with a smaller negative pressure or a lesser frequency of suction because this head is structured to use four colors, Bk, Y, M, and C, thus containing the Bk ink whose viscosity is lower. Consequently, the suction can be easier than a case where a head is structured to use only three colors, that is, Y, M, and C. However, even in the case of a color ink jet head structured to use the four colors, it is still necessary to set a sucking condition which is different from the one set for a head structured to use only a monochromic color.

Figure 8B:
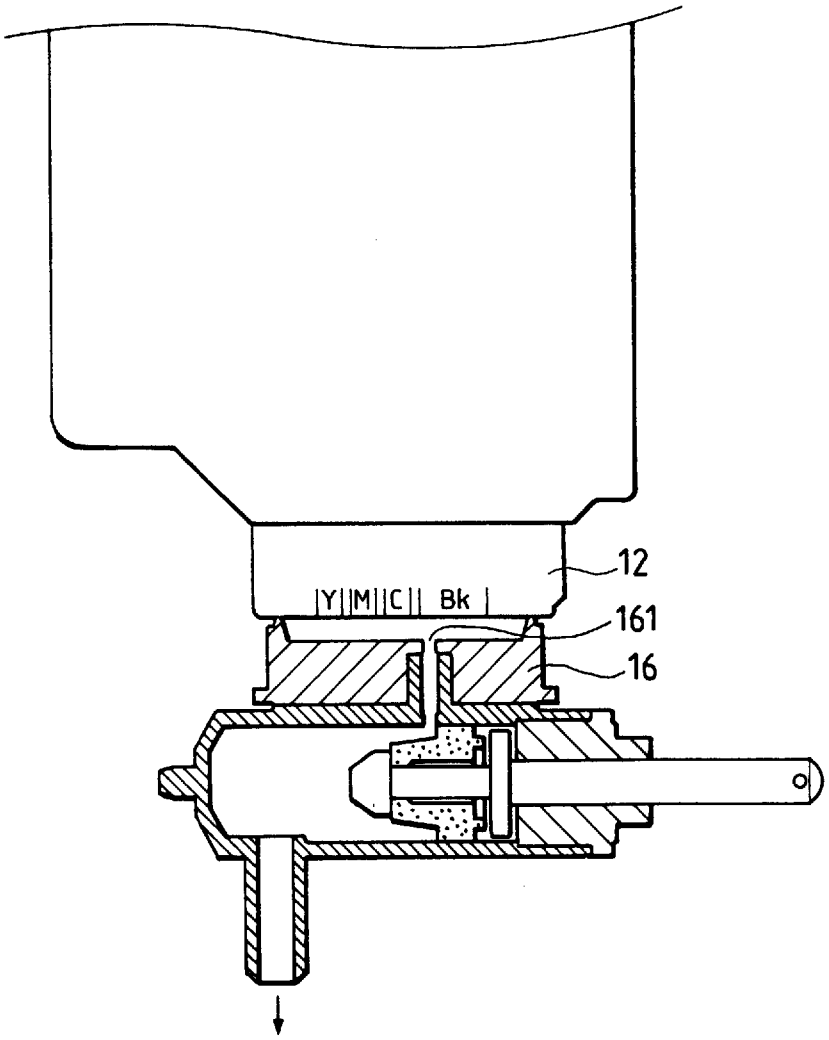
FIGS. 8A and 8B are views schematically showing the positional relationships between the suction port of a cap, and heads for use of monochrome and colors, respectively.
Figure 8A:
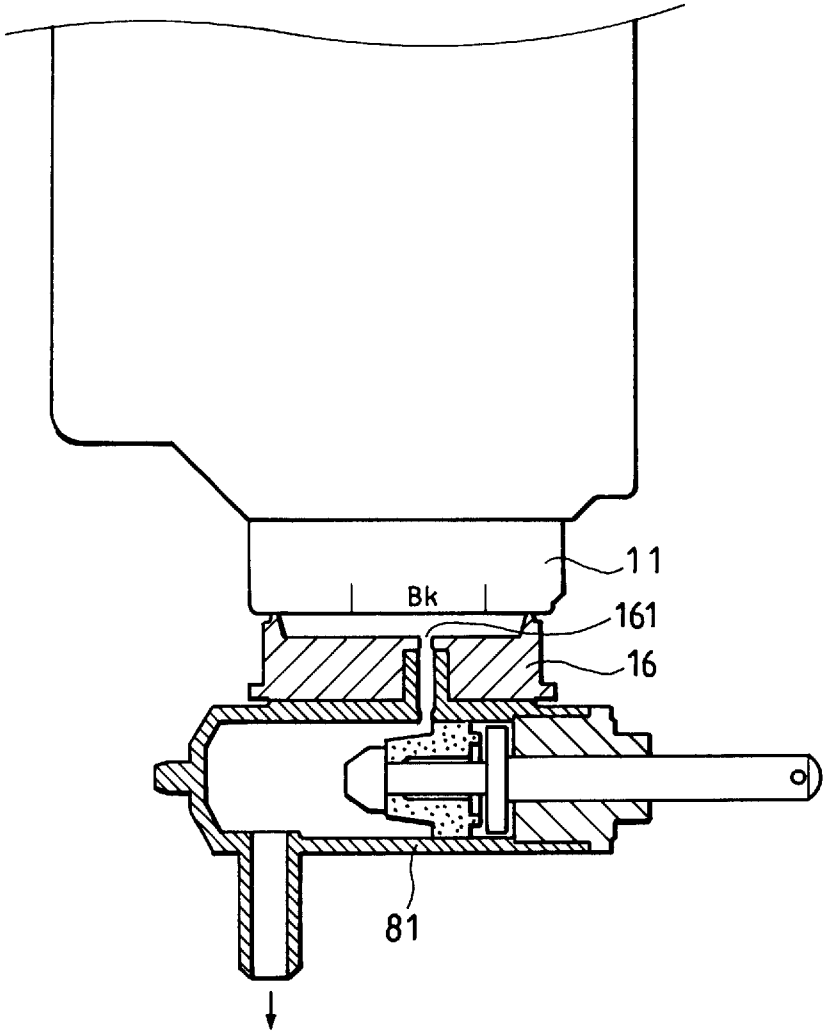

FIGS. 8A and 8B are views showing an embodiment wherein the interior of the cap is sucked by a suction pump.

Here, FIG. 8A represents a case where a monochrome ink jet recording head is used. FIG. 8B represents a case where a color ink jet recording head is used.

In FIGS. 8A and 8B, when the ink jet recording head is capped, the suction port 161 for the cap, which serves as a connecting unit for the suction pump 81, is in a position corresponding to the central region of the discharge port area for the monochrome ink jet recording head as shown in FIG. 8A, while it is in a position within a region facing the black ink discharge port area but deviated to the adjacent cyan ink discharge area side for the color ink jet recording head as shown in FIG. 8B.

With this positional arrangement of the suction port, it is possible to bring ink of higher density in a position closer to the suction port, that is, the nozzles can be arranged for black ink on one side of the suction port while those for cyan ink, magenta ink, and yellow ink, on the other side thereof (the densities of the ink colors being in a relationship of C>M>Y).

In this way, when the wasted ink is sucked by the pump from the suction port, ink is sucked toward the side where ink having a higher density is present, thus making it possible to suppress the mixture of each color ink to the minimum when it is sucked.

Figure 2A:
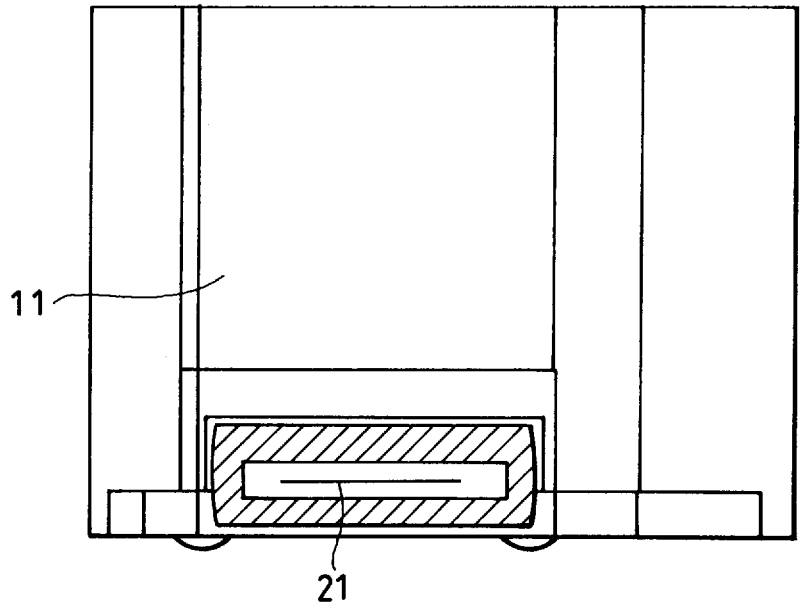
FIGS. 2A and 2B are front views schematically showing heads for use of monochrome and colors, respectively.
Figure 2B:
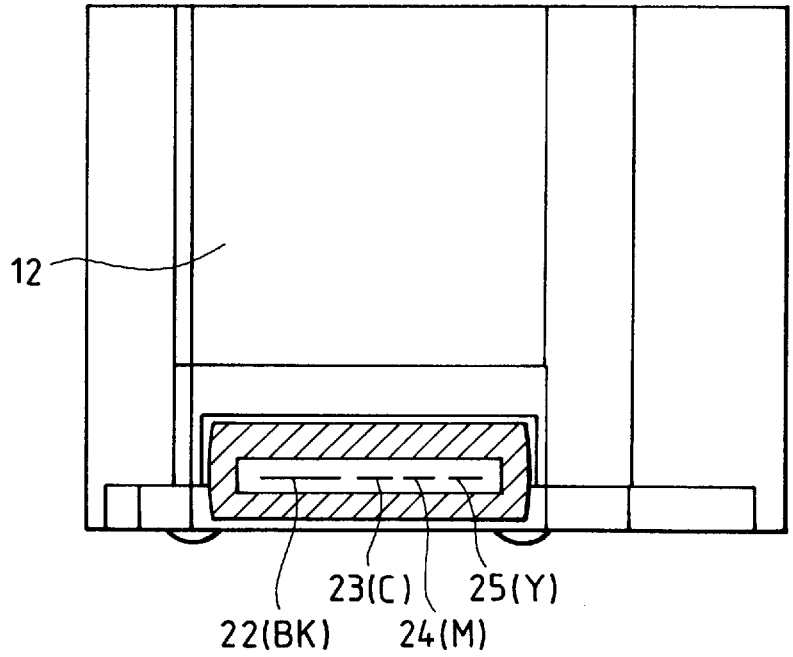

FIGS. 2A and 2B are front views of the monochrome ink jet head 11 and color ink jet head 12, each observed from the head surfaces, respectively. In FIGS. 2A and 2B, those portions indicated by slanted lines are the surfaces, which the cap 16 is coupled with in common, respectively, and are designed substantially in the same configuration. Here, in FIG. 2A, a reference numeral 21 designates the orifice line which discharges black ink, having 128 orifices for discharging droplets arranged in line with a density of 360 dpi. Likewise, in case of the color ink jet head 12, the orifice line is divided into four areas because the interior of the head is divided into four ink color sections. In FIG. 2B, a reference numeral 22 designates, as an example, the orifice line for black ink having 64 orifices with a density of 360 dpi; 23, the orifice line for cyan ink having 24 orifices with a density of 360 dpi; 24, the orifice line for magenta ink having 24 orifices with a density of 360 dpi; and 25, the orifice line for yellow ink having 24 orifices with a density of 360 dpi.

Figure 3:
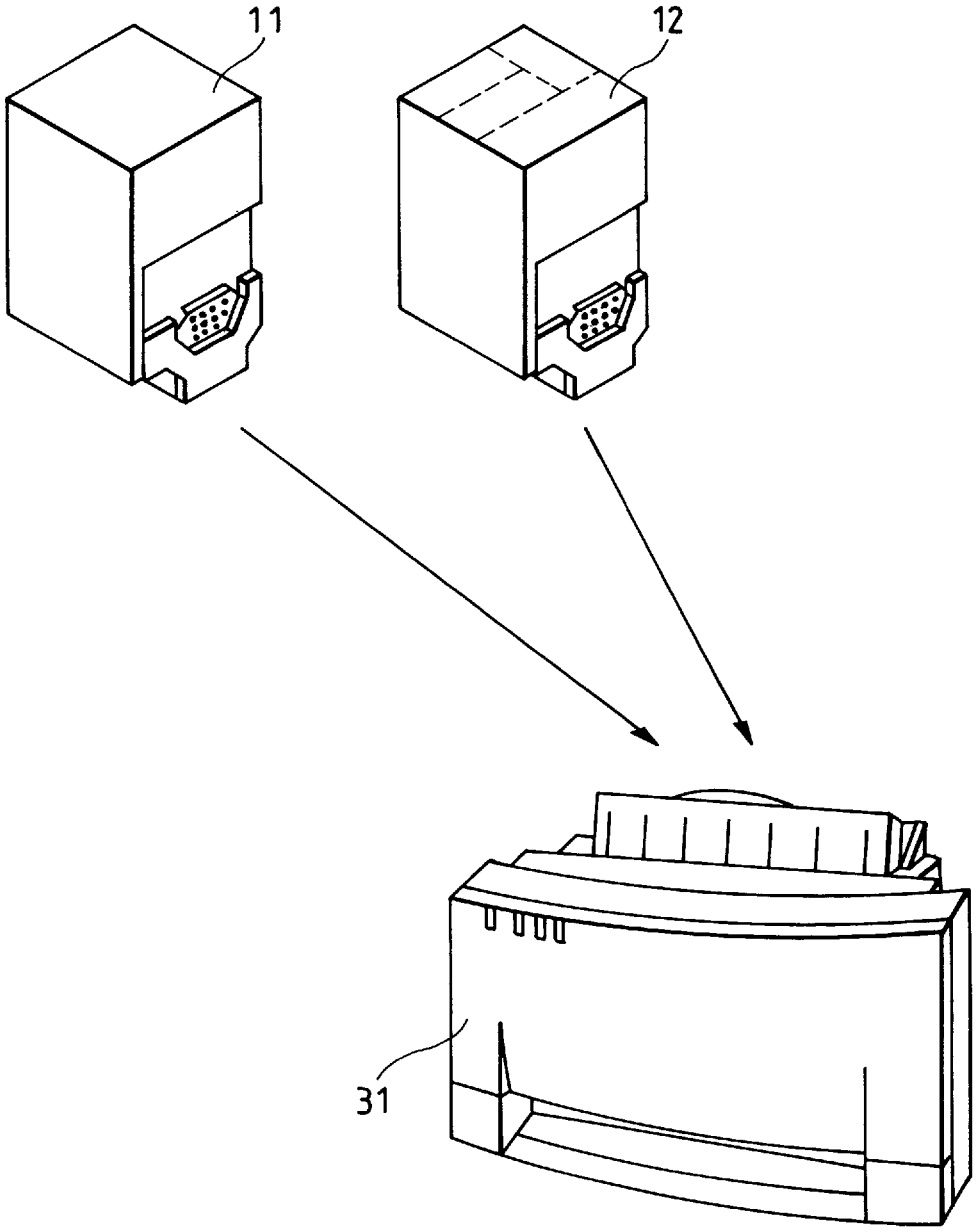
FIG. 3 is a view which schematically shows the outer appearance of a printer embodying the present invention.

FIG. 3 is a view which shows the outer appearance of a printer. In FIG. 3, a reference numeral 31 designates a printer structured by the ink jet recording apparatus in accordance with the present invention. As shown in FIG. 3, the monochrome ink jet head 11 and the color ink jet head 12 are installed on the printer 31 selectively in accordance with use, respectively. At this juncture, the members on the printer, that is, the carriage 14, electric signal terminal surface 15, and cap 16, are connected with plural kinds of heads, respectively. Further, in addition to the structure described above, a keeping box is provided to store in it the ink jet head which is not in use in order to prevent ink from the orifices being dried for such recording head.

Figure 4:
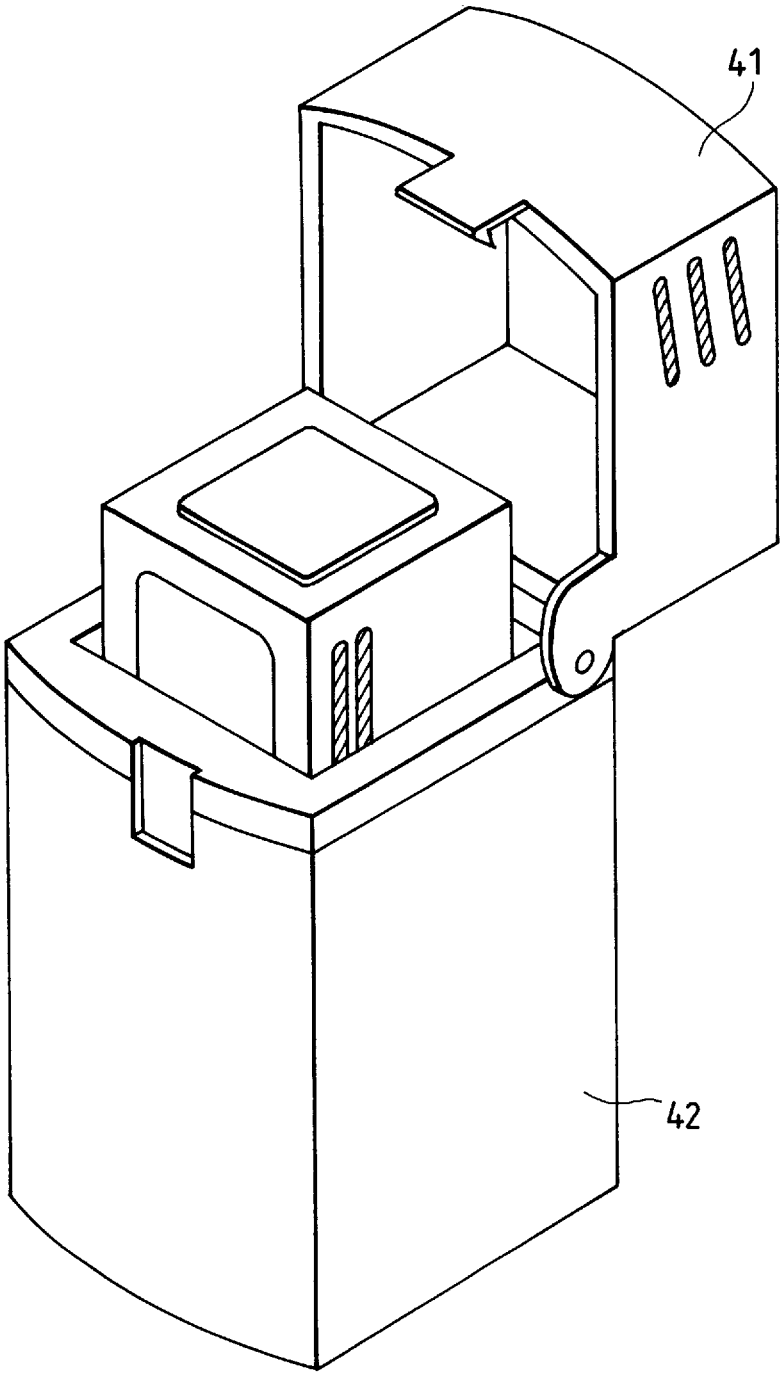
FIG. 4 is a view which schematically shows the outer appearance of a keeping box.

FIG. 4 is a view which shows the outer appearance of the keeping box. In FIG. 4, when a lid 41 is closed, a cap formed in the box main 42 and the head surface engage with each other to prevent ink from the orifices from being dried for the head which is not in use.

(Other Embodiments)

Figure 5A:
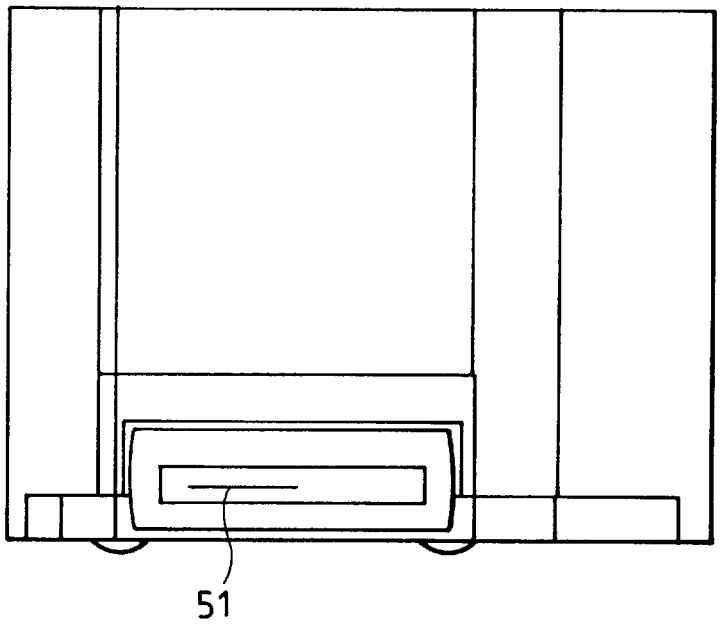
FIGS. 5A and 5B are surface views schematically showing heads having different numbers of orifices, respectively.
Figure 5B:
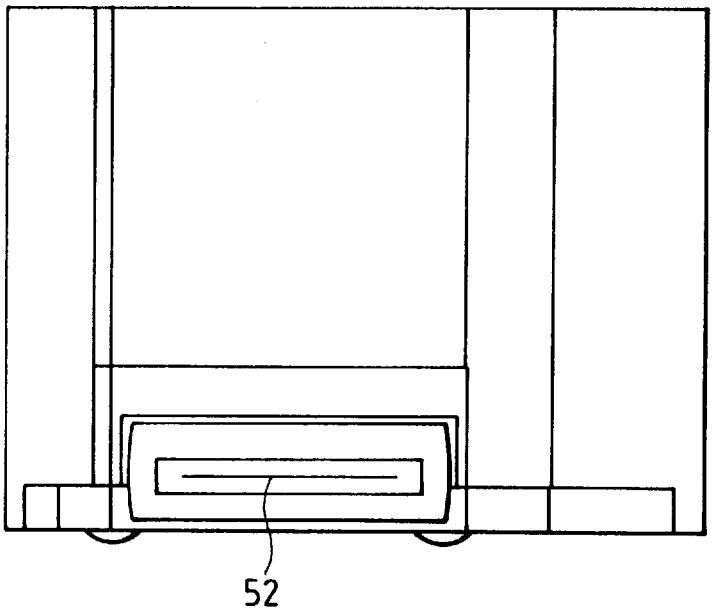

FIGS. 5A and 5B are views which represent another embodiment. FIGS. 5A and 5B are front views of plural heads which are observed from the head surfaces, respectively. A reference numeral 51 in FIG. 5A designates an orifice line having 64 orifices with a density of 360 dpi as an example, and 52, an orifice line having 128 orifices with a density of 360 dpi, as an example. All other structures are the same as the one described above, but by using heads of the kinds, it is possible to select plural heads having different recording speeds, and different costs resulting from the difference in orifice numbers depending on use, and perform the required recording.

Figure 6A:
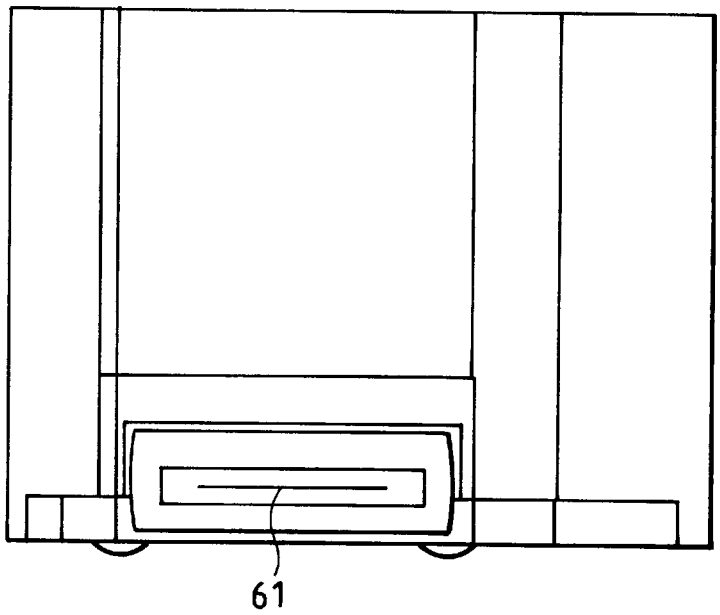
FIGS. 6A and 6B are surface views schematically showing heads having different densities of orifices, respectively.
Figure 6B:
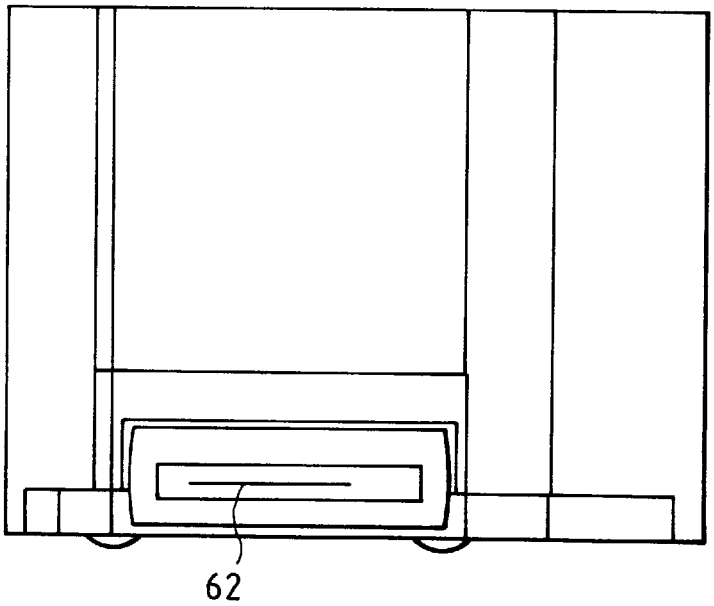

FIGS. 6A and 6B are views which represent still another embodiment. A reference numeral 61 in FIG. 6A designates an orifice line having 128 orifices with a density of 360 dpi as an example, and 62, an orifice line having 128 orifices with a density of 400 dpi, as an example. With the provision of heads of the kinds, it is possible to select heads having different recording densities depending on use, and perform the required recording.

(Others)

The present invention is capable of demonstrating excellent effects particularly on a recording head and recording apparatus of an ink jet type, among those of ink jet recording types, which performs recording by forming flying droplets by utilizing thermal energy.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electrothermal transducer disposed on a liquid (ink) retaining sheet or liquid passage whereby to cause the electrothermal transducer to generate thermal energy to produce film boiling on the thermoactive portion of recording head, thus effectively leading to the resultant formation of a bubble in the recording liquid (ink) one to one for each of the driving signals. By the development and contraction of the bubble, the liquid (ink) is discharged through a discharging port to produce at least one droplet. The driving signal is more preferably in the form of pulses because the development and contraction of the bubble can be effectuated instantaneously, and, therefore, the liquid (ink) is discharged with quick response.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention.

In addition, the present invention is effectively applicable to the structure disclosed in Japanese Patent Application Laid-Open No. 59-123670 wherein a common slit is used as the discharging ports for plural electrothermal transducers, and to the structure disclosed in Japanese Patent Application Laid-Open No. 59-138461 wherein an aperture for absorbing pressure wave of the thermal energy is formed corresponding to the discharge ports.

Further, for a recording head of a full-line type having a length corresponding to the width of the largest recording medium recordable by the recording apparatus, the present invention can demonstrate the above-mentioned effects more effectively, irrespective of the structure to satisfy its length by combining a plurality of recording heads disclosed in the specifications described above or by a single recording head integrally formed.

Furthermore, the present invention is effectively adoptable irrespective of whether the recording head is of an exchangeable chip type which can be electrically connected with the apparatus main body or of a cartridge type in which an ink tank is formed integrally with the recording head itself.

Also, it is preferable to additionally provide a recording head with recovery means and preliminarily auxiliary means as constituents of the recording apparatus in accordance with the embodiments of the present invention because these additional means will contribute to enabling the effectiveness of the present invention to be more stabilized. To name them specifically, these are capping means for the recording head, cleaning means, suction recovery means as described above, and in addition, recovery means by use of compression, preheating means such as electrothermal transducers or heating elements other than such transducers or the combination of those types of elements. The adoption of a predischarge mode, which performs discharging other than the regular discharge, is also contributable to executing a stabilized recording.

Also, the present invention is extremely effective in applying it not only to a recording mode in which only main color such as black is used, but also to an apparatus having at least one of multi-color modes with ink of different colors, or a full-color mode using the mixture of the colors, irrespective of whether the recording heads are integrally structured or it is structured by a combination of plural recording heads.

Moreover, in the embodiments of the present invention described above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable discharge in general, the ink may be such as to be liquefied when the applicable recording signals are given.

In addition, while positively preventing the temperature from rising due to the thermal energy by the use of such energy as an energy to be used for changing states of ink from solid to liquid, or by use of the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain the ink in the form of liquid or solid in the recesses or through holes of a porous sheet such as disclosed in Japanese Patent Application Laid-Open No. 54-56847 or 60-71260, thus enabling the retained ink to face the electrothermal transducers. In the present invention, the most effective method for the various kinds of ink mentioned above is the one capable of implementing the method using film boiling as described above.

Further, as the mode of the recording apparatus in accordance with the embodiments of the present invention, it may be possible to adopt a copying apparatus combined with a reader in addition to the image output terminal which is integrally or independently provided for a word processor, computer, or other information processing apparatus, and furthermore, it may be possible to adopt a mode of a facsimile apparatus having transmission and reception functions.

In accordance with the embodiments described above, there are prepared the different kinds of plural ink jet heads which can be attached to or detached from a single carriage for common use, and then, an ink jet head is selected from among these heads and mounted on the carriage for use. In this way, it becomes possible to widen the range of the kinds of images which can be recorded.

Also, with the additional provision of a structure whereby to arrange in the black discharge area the suction port in the cap conductively connected with a suction pump, it becomes possible to implement the suction recovery for a color recording head while suppressing the mixture of colors.

Also, in accordance with the embodiments of the present invention, a cap member is utilized for effectuating a stable suction recovery of a new ink jet head having many nozzles, and then, the suction recovery can be performed in a combination of ink having a relatively high and low deposition tendencies for a second ink jet head provided with plural discharge units each for ink of different properties to be discharged in a range which is substantially the same as the nozzle area of a first ink jet head, thus avoiding the defective suction which may take place in a case where each suction is executed individually for each of the discharge units by use of different caps, respectively.

Further, among the Y, M, C, and Bk single heads (which are good enough if only provided with at least plural discharge units) in accordance with the embodiments of the present invention, Bk is the ink which is relatively easy to be stuck while Y, M, C are the kinds of ink which are not relatively easy to be stuck. However, the present invention is applicable even when these ink properties are inverted, or effectively applicable particularly in a structure wherein, among plural kinds of ink, one head is prepared for the ink whose property is different, and then, this head is sucked by use of one cap. Further, there is no problem at all in attempting the suction recovery for a monochrome single head whose amount of ink is great at the time of the suction recovery.

In the embodiments of the present invention, the "ink property" is meant to include any one of the ink having difference in its characteristics in moving in the ink exhaust path arranged for the suction recovery (ink viscosity, deposition tendency due to surface tension, or the like for instance). The "different ink property" is meant to include a case where at least one of these characteristics is different.

Moreover, in accordance with the embodiments of the present invention, the following effects can be obtained by providing a single carriage capable of supporting and fixing for common use each of plural kinds of ink jet heads having different number of nozzles; plural kinds of ink jet heads having different nozzle pitches, or plural kinds of ink jet heads for discharging a monochromic color or multiple colors of ink, and an electrically connecting unit which is coupled to the electric signal terminal surface of each ink jet head, a single cap to cover the recording droplet discharge surface of each of the ink jet heads for common use, and then, by exchanging the plural ink jet heads for recording:

1. It becomes possible to form images in a wide range in accordance with its use.
2. It becomes possible to provide an apparatus at a lower cost by unifying each part required for the main body.
3. It becomes possible to make the apparatus smaller by unifying each part required for the main body.

Also, in accordance with the embodiments of the present invention, the suction port for conducting the exhausted ink from the discharge ports to a pump is arranged to be positioned close to the black ink discharge port. In this case, the mixture of color ink can be suppressed to the minimum when color ink and black ink should be sucked together at a time. As a result, it is possible to reduce the number of predischarges required for exhausting ink from the ink paths in order to remove the mixed color ink infiltrated into the ink paths when performing the recovery of color mixture before recording, hence effectively reducing the running cost of the apparatus.

What is claimed is:

1. An ink jet recording apparatus to which either one of both a first and a second ink jet recording head is mountable, comprising:

a carriage for supporting either one of both said first and second ink jet recording heads, wherein said first ink jet recording head is provided with a first area of discharge ports for discharging ink which is relatively easily deposited and a second area of discharge ports for discharging ink which is relatively difficult to deposit, and wherein said second ink jet recording head is provided with discharge ports for discharging ink whose discharge ease does not differ;

a cap member; and a suction mechanism for sucking ink retained in the cap member, said suction mechanism having a suction mechanism communication opening conductively connecting said suction mechanism with said cap member, and provided within a range facing the first area and deviated to said second area, wherein said cap member is comprised of a single cap dimensioned to cover the discharge ports of the first and the second ink let recording heads, whichever is mounted.

2. An ink jet recording apparatus according to claim 1, wherein said first ink jet recording head supported on said carriage is provided with electrothermal transducers, and discharges ink from ink discharge ports of said recording head by the application of thermal energy generated by said electrothermal transducers.

3. An apparatus according to claim 1, wherein said first area is provided with a discharge port for discharging black ink and said second area is provided with a discharge port for discharging ink having a color other than black.

4. An apparatus according to claim 3, wherein said second area is provided with a discharge port for discharging yellow ink, a discharge port for discharging magenta ink and a discharge port for discharging cyan ink.

5. An apparatus according to claim 3, wherein said first ink jet recording head is provided in an array with a discharge port for discharging yellow ink, a discharge port for discharging magenta ink, a discharge port for discharging cyan ink, and a discharge port for discharging black ink.

6. An apparatus according to claims 4 or 5, wherein said suction mechanism communication opening is provided for said cap member and arranged to face a position deviated to a cyan ink discharge port area side within the region facing a black ink discharge port area of said first ink jet recording head.

7. A method for recovering an ink jet recording apparatus to which either one of both a first and a second ink let recording head is mountable, comprising the steps of:

arranging a carriage for supporting either one of both said first and second ink let recording heads, wherein said first ink jet recording head is provided with a first area of discharge ports for discharging ink which is relatively easily deposited and a second area of discharge ports for discharging ink which is relatively difficult to deposit, and wherein said second ink let recording head is provided with discharge ports for discharging ink whose discharge ease does not differ;

arranging a cap member;

arranging a suction mechanism for sucking ink retained in said cap member; and arranging a suction mechanism communication opening conductively connecting said suction mechanism with said cap member, and provided within a range corresponding to the first area and deviated to said second area, wherein said cap member is comprised of a single cap dimensioned to cover the discharge ports of the first and the second ink let recording heads, whichever is mounted.

8. A method according to claim 7, wherein said step of arranging a carriage includes providing said first area with a discharge port for discharging black ink and providing said second area with a discharge port for discharging ink having a color other than black.

9. A method according to claim 8, wherein said step of arranging a carriage includes providing said second area with a discharge port for discharging yellow ink, a discharge port for discharging magenta ink and a discharge port for discharging cyan ink.

10. A method according to claim 8, wherein said step of arranging a carriage includes providing said first ink jet recording head in an array with a discharge port for discharging yellow ink, a discharge port for discharging magenta ink, a discharge port for discharging cyan ink, and a discharge port for discharging black ink.

11. An ink jet recording apparatus for recording with either one of both a first and a second ink jet recording head, the first ink jet recording head having a first area of discharge ports for discharging ink which is relatively easily deposited and a second area of discharge ports for discharging ink which is relatively difficult to deposit, and the second ink let recording head having discharge ports for discharging ink whose discharge ease does not differ, said apparatus comprising:

a cap member;

a head supporting member for supporting either one of both said first and second ink jet recording heads so that said supported ink jet recording head is capable of opposing said cap member; and an opening portion located on said cap member within a range facing said first area and deviated to said second area when said first area and said second area are covered by said cap member at a position where said supported ink jet recording head supported by said head supporting member is opposed to said cap member, said opening portion guiding ink discharged in said cap member to an outside of said cap member, wherein said cap member is comprised of a single cap dimensioned to cover the discharge ports of the first and the second ink jet recording heads, whichever is mounted.

12. An apparatus according to claim 11, wherein said first area is provided with a discharge port for discharging black ink and said second area is provided with a discharge port for discharging ink having a color other than black.

13. An apparatus according to claim 12, wherein said second area is provided with a discharge port for discharging yellow ink, a discharge port for discharging magenta ink, and a discharge port for discharging cyan ink.

14. An apparatus according to claim 12, wherein said first ink jet recording head is provided in an array with a discharge port for discharging yellow ink, a discharge port for discharging magenta ink, a discharge port for discharging cyan ink, and a discharge port for discharging black ink.

15. A method for recovering an ink jet recording apparatus, said recording apparatus recording with either one of both a first and a second ink jet recording head, the first ink jet recording head having a first area of discharge ports for discharging ink which is relatively easily deposited and a second area of discharge ports for discharging ink which is relatively difficult to deposit, and the second ink jet recording head having discharge ports for discharging ink whose discharge ease does not change, said method comprising the steps of:

providing a cap member;

providing a head supporting member for supporting either one of both said first and second ink jet recording heads so that said supported ink jet recording head is capable of opposing said cap member;

providing an opening portion located on said cap member within a range facing said first area and deviated to said second area when said first area and said second area are covered by said cap member at a position where said ink jet recording head supported by said head supporting member is opposed to said cap member; and guiding ink discharged in said cap member with said opening portion to an outside of said cap member, wherein said cap member is comprised of a single cap dimensioned to cover the discharge ports of the first and the second ink let recording heads, whichever is mounted.

16. A method according to claim 15, wherein said step of arranging a carriage includes providing said first area with a discharge port for discharging black ink and providing said second area with a discharge port for discharging ink having a color other than black.

17. A method according to claim 16, wherein said step of arranging a carriage includes providing said second area with a discharge port for discharging yellow ink, a discharge port for discharging magenta ink, and a discharge port for discharging cyan ink.

18. A method according to claim 16, wherein said step of arranging a carriage includes providing said first ink jet recording head in an array with a discharge port for discharging yellow ink, a discharge port for discharging magenta ink, a discharge port for discharging cyan ink, and a discharge port for discharging black ink.

* * * * *

UNITED STATES PATENT AND TRADEMARK OFFICE

CERTIFICATE OF CORRECTION

PATENT NO. : 5,831,645

DATED : November 3, 1998

INVENTOR(S) : JUNJI SHIMODA

It is certified that error appears in the above-identified patent and that said Letters Patent is hereby corrected as shown below:

COLUMN 10

Line 50, "let" should read --jet--.

COLUMN 11

Line 10, "let" should read --jet--.

Line 13, "let" should read --jet--.

Line 18, "let" should read --jet--.

Line 31, "let" should read --jet--.

Line 54, "let" should read --jet--.

COLUMN 12

Line 48, "let" should read --jet--.

Signed and Sealed this

Eighteenth Day of May, 1999

*Attest:*

*Attesting Officer*

Q. TODD DICKINSON

*Acting Commissioner of Patents and Trademarks*